United States Patent [19]

Topuett

[11] Patent Number: 4,896,841

[45] Date of Patent: Jan. 30, 1990

[54] METHOD AND APPARATUS FOR LOCATING AND LOOSENING A RESERVE YARN WINDING ON A TEXTILE SPINNING COP OR THE LIKE

[75] Inventor: Heinz-Lorenz Topuett, Moenchengladbach, Fed. Rep. of Germany

[73] Assignee: W. Schlafhorst & Co., Fed. Rep. of Germany

[21] Appl. No.: 310,331

[22] Filed: Feb. 13, 1989

[30] Foreign Application Priority Data

Feb. 12, 1988 [DE] Fed. Rep. of Germany ..... 3804373

[51] Int. Cl.[4] ..... B65H 54/22; B65H 67/08

[52] U.S. Cl. ..... 242/35.6 E; 242/18 R

[58] Field of Search ..... 242/35.6 E, 35.6 R, 242/35.5 R, 35.5 A, 18 R

[56] References Cited

U.S. PATENT DOCUMENTS

| | | | |
|---|---|---|---|
| 2,675,971 | 4/1954 | Abbott | 242/35.6 R |
| 3,224,694 | 12/1965 | Oishi | 242/35.5 R |
| 3,381,908 | 5/1968 | Igushi et al. | 242/35.5 R |
| 4,125,229 | 11/1978 | Dillon | 242/18 R |

FOREIGN PATENT DOCUMENTS

| | | | |
|---|---|---|---|
| 7417010 | 9/1974 | Fed. Rep. of Germany . | |
| 2423493 | 11/1975 | Fed. Rep. of Germany . | |
| 3602002 | 8/1986 | Fed. Rep. of Germany . | |
| 6502 | 2/1974 | Japan | 242/35.6 E |
| 430534 | 8/1967 | Switzerland . | |

*Primary Examiner*—Stanley N. Gilreath

*Attorney, Agent, or Firm*—Shefte, Pinckney & Sawyer

[57] ABSTRACT

A method and apparatus for locating and loosening a reserve yarn winding on a textile spinning cop wherein the cop is rotated about its axis while a reserve yarn locating implement with a hook having a reversely-directed rounded tip is placed against the cop periphery with the tip facing opposite the direction of cop rotation to catch the reserve yarn winding within the hook and, thereafter, the implement is withdrawn tangentially from the cop to draw with it the reserve yarn winding until the winding comes loose from the cop or breaks.

14 Claims, 4 Drawing Sheets

METHOD AND APPARATUS FOR LOCATING AND LOOSENING A RESERVE YARN WINDING ON A TEXTILE SPINNING COP OR THE LIKE

BACKGROUND OF THE INVENTION

The present invention relates to a method and apparatus for locating and loosening a reserve yarn winding on a textile spinning cop or a like textile yarn bobbin of the type wherein the reserve yarn winding is wound with a relatively large rise in the direction from the nose end of the cop to the foot end of the cop.

In ring spinning machines and the like, it is customary at the completion of the formation of a yarn cop to form a reserve winding of the terminal length of the yarn to extend from the upper end, or nose, of the cop to the lower end, or foot, of the cop. For this purpose, for example, the ring rail in a ring spinning machine is moved at a relatively rapid rate from the upper nose end of the cops being wound downwardly therealong while the spindles on which the cops are supported are in the process of decelerating. The reserve yarn winding may then be terminated at the foot end of the cop in an underwinding.

Typically, such a reserve yarn winding is formed in only a few wraps of the yarn about the cop. For example, approximately five yarn windings are normally located on the upper conical portion of the yarn buildup of the cop with approximately five to six windings formed on the cylindrical portion of the yarn-buildup on the cop.

When such cops are prepared for unwinding, it is necessary and important to expose the terminal yarn end of the reserve yarn winding without damaging the reserve yarn winding, so that the terminal yarn end may be easily grasped, such as by a winding device with reliability.

A reserve winding of yarn which lies firmly on the outer periphery of the yarn buildup of the cop is advantageous in facilitating the transportation of the cop from the spinning machine to a subsequent winding machine in that the reserve yarn winding is less likely to catch on other objects and be torn from the cop or to become entangled with the reserve yarn windings of other cops. On the other hand, the reserve yarn winding will remain firmly adhered to the cop at the yarn delivery position of an automatic winder. It is accordingly advantageous to locate and loosen the reserve yarn winding in advance of a subsequent unwinding operation, such as at an automatic winder, or even before the cop is inserted at the winding position. This procedure is commonly referred to as cop preparation and is preferably performed in the immediate vicinity of an automatic winder or like winding machine.

In the course of a cop preparation procedure, the reserve yarn winding can be exposed and placed at a defined position with respect to the cop. For example, it is customary to shorten the terminal end of the reserve yarn winding to a predetermined length and to insert the yarn end into the interior of the tubular core of the cop, either before or after the shortening takes place, so that the yarn end loops around the terminal end edge of the tube so as to be positioned to be reliably grasped when the cop is placed in a winding position at the winding machine.

Problems have been experienced in locating and loosening the reserve yarn winding utilizing conventional suction, blowing, scratching and catching devices for this purpose which, in practice, have not been found to perform with satisfactory reliability.

SUMMARY OF THE INVENTION

It is accordingly an object of the present invention to provide a novel method and apparatus by which the reserve yarn winding of textile spinning cops may be located and loosened rapidly and reliably in a simple manner.

According to the method of the present invention, a yarn locating implement is utilized, the implement basically including a hook formed with a reversely directed rounded tip such as that of a crochet needle. While the cop is rotated about its longitudinal axis, the tip of the hook is positioned in contact with the outer periphery of the cop with the tip facing oppositely of the direction of cop rotation to be disposed for catching the reserve yarn winding with the hook. Thereafter, the hook is withdrawn generally tangentially from the cop to pull the reserve yarn winding to loosen it from the cop, the hook being operative to hold securely the reserve yarn winding during the withdrawal step until the terminal end of the winding is loosened from the cop or disentangled from another yarn or the reserve yarn winding breaks to produce a free yarn end, as the case may be. A commercially available crochet needle has been found to function advantageously as the locating implement.

In the event the yarn end of the reserve yarn winding is freed by this procedure, the end disengages from the hook of the locating implement after a brief period of time due to the continuing rotation of the cop. On the other hand, if the terminal yarn end of the reserve yarn winding does not readily come free from the cop or from any entanglement, the reserve yarn winding breaks at an intermediate point along its length due to progressively increasing yarn tension which, of course, results from the continuing rotation of the cop and the withdrawal of the hook away therefrom. Assuming the cause of the breakage in this latter instance is a firm attachment of the original terminal yarn end of the reserve yarn winding to the foot of the yarn-supporting tube of the cop, the original terminal yarn end remains connected in some manner to the tube foot, but this attachment does not hinder the subsequent unwinding of yarn from the cop. In most cases, a breakage of the reserve yarn winding will occur along the length of the yarn immediately at the hook of the locating implement because the strongest yarn tension or, at least, the greatest yarn deflection prevails at this point. However, depending on the cross-section of the particular yarn, the yarn of course may also break at the weakest point along its length between the hook and the cop.

The reliability of the present method in locating the reserve yarn winding is surprising. It is believed that the reliability results from the uneven peripheral surface of the cop consisting essentially of peaks and valleys extending transversely to the longitudinal axis of the cop as formed by the wraps of yarn thereabout while, on the other hand, the reserve yarn winding essentially extends obliquely from one end of the cop to the other over the highest yarn peaks at the cop periphery. Contact of the locating hook with the peripheral surface of the rotating cop occurs in most instances in a yarn valley of the cop periphery but, in the event the hook contacts a yarn peak, the peak should yield under the engagement force of the hook so that the hook penetrates somewhat into the cop periphery or between yarn windings or the yarn layers. During the course of cop rotation, the reserve yarn winding is caused to move in a transverse manner with respect to the locating hook so as to slide along the shaft of the hook and into the slot-like area defined within the hook. The movement of the reserve yarn winding with the cop rotation of course cannot overcome the retaining engagement by the rearwardly directed tip of the hook even if considerable oscillation occurs during the yarn locating sequence.

According to a further aspect of the present invention, the cop is preferably rotated about its longitudinal axis in the same direction as the yarn winding thereabout, i.e., opposite to the direction of winding of the reserve yarn winding. Thus, once the reserve yarn winding is caught within the hook of the locating implement, the end portion of the reserve yarn winding at the foot of the supporting tube tends to loosen rather than the end portion of the winding extending to the tube nose. Otherwise, a danger exists that other wraps of the yarn would be unwound from the nose area of the cop as the rotation of the cop continues which, of course, would be undesirable even if the reserve yarn winding is loosened in the process.

It is further preferred in the method of the present invention that the tip of the locating hook be maintained in contact with the outer periphery of the rotating cop for a predetermined time sufficient for the cop to complete between approximately one and two revolutions, after which the hook is withdrawn tangentially from the cop regardless of whether the hook has successfully caught the reserve yarn winding.

The actual time required for performing this procedure of locating the reserve yarn winding need not be precisely determined. Theoretically, the locating hook should catch the reserve yarn winding no later than by the completion of one cop revolution after the hook is positioned in contact with the cop periphery or, if this has not occurred within the first cop revolution, then it is to be expected that the reserve yarn winding will be caught in the course of the second cop revolution.

It is of course possible to maintain the locating hook in contact with the cop beyond the second cop revolution. However, continuing engagement of the hook with the cop represents an unnecessary loss of time and, further, an increasing risk exists that the end of the reserve yarn winding may readily loosen and then be wound by the locating hook in parallel windings around the cop during the course of multiple continuing cop revolutions which, of course, would undesirably reattach the reserve yarn winding to the cop after having been initially loosened.

According to another aspect of the present method, the tangential withdrawal of the hook from the cop is performed within a plane tangential to the cop in a direction substantially transverse with respect to the reserve yarn winding, taking into consideration the position, rotational direction and direction of winding of the reserve yarn winding Thus, the withdrawal of the locating hook may take place at the intersection between the aforementioned plane tangential to the cop and another plane which extends in generally perpendicular relation to the tangential plane obliquely with respect to the longitudinal axis, i.e. rotational axis, of the cop. The oblique plane is selected such that the withdrawal of the hook has a greater component of movement transversely with respect to the lengthwise direction of the reserve yarn winding. In some cases, the withdrawal of the yarn hook may occur substantially perpendicularly with respect to the lengthwise direction of the reserve yarn winding. However, whether the angle of hook withdrawal with respect to the reserve yarn winding need have this great a transverse component of movement is to be determined on a case-by-case basis. Additionally, the size of the locating hook in relation to the cross-sectional thickness of the yarn is an additional factor to be considered.

The tip of the locating hook may be moved and held in contact with the outer periphery of the cop in various manners. For example, the locating implement may be pivoted laterally with respect to the cop about the lengthwise extent of the implement to bring the tip of the hook into contact with the cop and, subsequently, the implement may be withdrawn tangentially from the cop. However, it is preferred in the present method that the locating hook be advanced into contact with the outer cop periphery tangentially with respect to the cop along the same path of movement as the hook is withdrawn from the cop. This movement may be accomplished in two possible manners. First, the locating hook may be moved into its operative disposition and only then is the cop positioned in contact against the tip of the hook, in which case the rotation of the cop may be initiated before or after contact takes place with the hook. Alternatively, rotation of the cop may first be initiated at a generally fixed position and the locating hook is then moved into peripheral contact with the cop.

Since it is assumed that the yarn windings about the cop produce a typically uneven and eccentric cop periphery, it is preferred that a guide member be provided for guiding the hook during positioning of the hook with the guide device being positioned in engagement with the outer periphery of the cop during the hook-positioning step. The guide member assures a relatively uniform contact of the locating hook with the cop periphery, preventing the hook from penetrating too deeply into the yarn build-up on the cop and also preventing the hook from being unintentionally lifted off the cop surface.

The present invention also provides an apparatus adapted for locating and loosening a reserve yarn winding on a cop according to the aforedescribed method. Briefly summarized, the apparatus includes means for supporting and rotating a cop about its longitudinal axis, a locating implement of the aforementioned type having a hook formed with a reversely directed rounded tip, and means for positioning the tip of the hook in contact with the outer periphery of the cop with the tip facing oppositely of the direction of cop rotation for catching the reserve yarn winding with the hook and for withdrawing the hook generally tangentially from the cop to pull the reserve yarn winding to loosen it from the cop. Preferably, a movable support member is provided for supporting and manipulating the locating implement, which advantageously may be a commercially available crochet needle.

The hook positioning and withdrawing means may be adapted to selectively determine the time required for completing the yarn locating cycle. For example, the cycle time may be terminated by a signal produced when the reserve yarn winding is caught by the locating hook. On the other hand, the cycle time can be established as a function of the number of cop revolutions which occur during the cycle. It is also possible to terminate the yarn locating cycle upon completion of a predetermined maximum elapsed time period. In any event, it is important that the locating hook be withdrawn out of its operative position against the cop in a direction tangentially with respect to the cop and then brought into a resting position either tangentially or in an arcuate path preferably concave with respect to the cop. It is generally less important in what manner the locating hook is brought into operative disposition in contact with the cop periphery.

According to a further aspect of the present apparatus, the cop supporting and rotating means is arranged to rotate the cop about its longitudinal axis in the same direction as the yarn wraps thereabout, i.e., opposite the winding direction of the reserve yarn winding.

The hook positioning and withdrawing means is preferably associated with a control means for maintaining the tip of the hook in contact with the outer periphery of the cop for a predetermined time sufficient for the cop supporting and rotating means to complete between approximately one and two revolutions of the cop.

Further, the hook positioning and withdrawing means is arranged for withdrawing the hook in a direction substantially transverse with respect to the reserve yarn winding, preferably, as mentioned above, along the intersection between a plane tangential to the cop and another plane which is oriented perpendicularly with respect to the tangential plane and obliquely with respect to the longitudinal axis of rotation of the cop. Advantageously, the movable support member and the yarn locating implement attached thereto follow the same path of movement for advancement of the hook into, and withdrawal of the hook out of, operative disposition in contact with the outer periphery of the cop, preferably in a tangential plane as described, in order to avoid complicated articulation controls or the like, which makes possible a simple positioning of the hook with respect to the cop.

Thus, the movable support member to which the locating implement is attached may be arranged to move toward and away from the cop at the intersection between a plane tangential to the cop and another plane perpendicular to the cop axis and to the tangential plane. Alternatively, the movable support member can be arranged to move toward and away from the cop at the intersection between a plane tangential to the cop and a plane oblique to the longitudinal cop axis and perpendicular to the tangential plane. For example, the support member may be moved simultaneously in two different directions in order to move the hook tangentially and obliquely with respect to the cop.

It is advantageous for the path of movement of the support member and the locating implement to extend essentially transversely with respect to the lengthwise direction of the reserve yarn winding on the cop. For this purpose, a substantially straight or linear path of movement is generally sufficient to assure that the locating hook is withdrawn transversely with respect to the reserve yarn winding after locating and engaging the winding.

According to a further feature of the present apparatus, a guide member is provide for engagement with the outer periphery of the cop during positioning of the hook in order to guide the hook during its positioning movement. In one embodiment, the guide member is arranged for movement into and out of contact with the outer cop periphery independently of, but in relation to, movement of the locating hook, e.g., laterally with respect to the tangential plane of hook movement. Alternatively, the guide member may be attached to the support member for integral movement with the support member and the hook.

In the preferred embodiment, means is provided for adjusting the disposition of the hook relative to the outer periphery of the cop. For example, the adjusting means may be located on the hook guide member. Preferably, the adjusting device is a movable adjustment screw positioned in engagement with the hook or otherwise with the locating implement.

The guide member includes a cop engagement surface or surfaces immediately adjacent the locating hook, preferably at opposite sides of the hook. Thus, the support surfaces may be brought into contact with the cop periphery with a predetermined force of engagement and, through the adjusting means, the desired contact between the tip of the hook and the outer cop periphery, including the depth of penetration of the tip between the yarn windings of the cop, can be controlled.

DESCRIPTION OF THE PREFERRED EMBODIMENT

Figure 1:
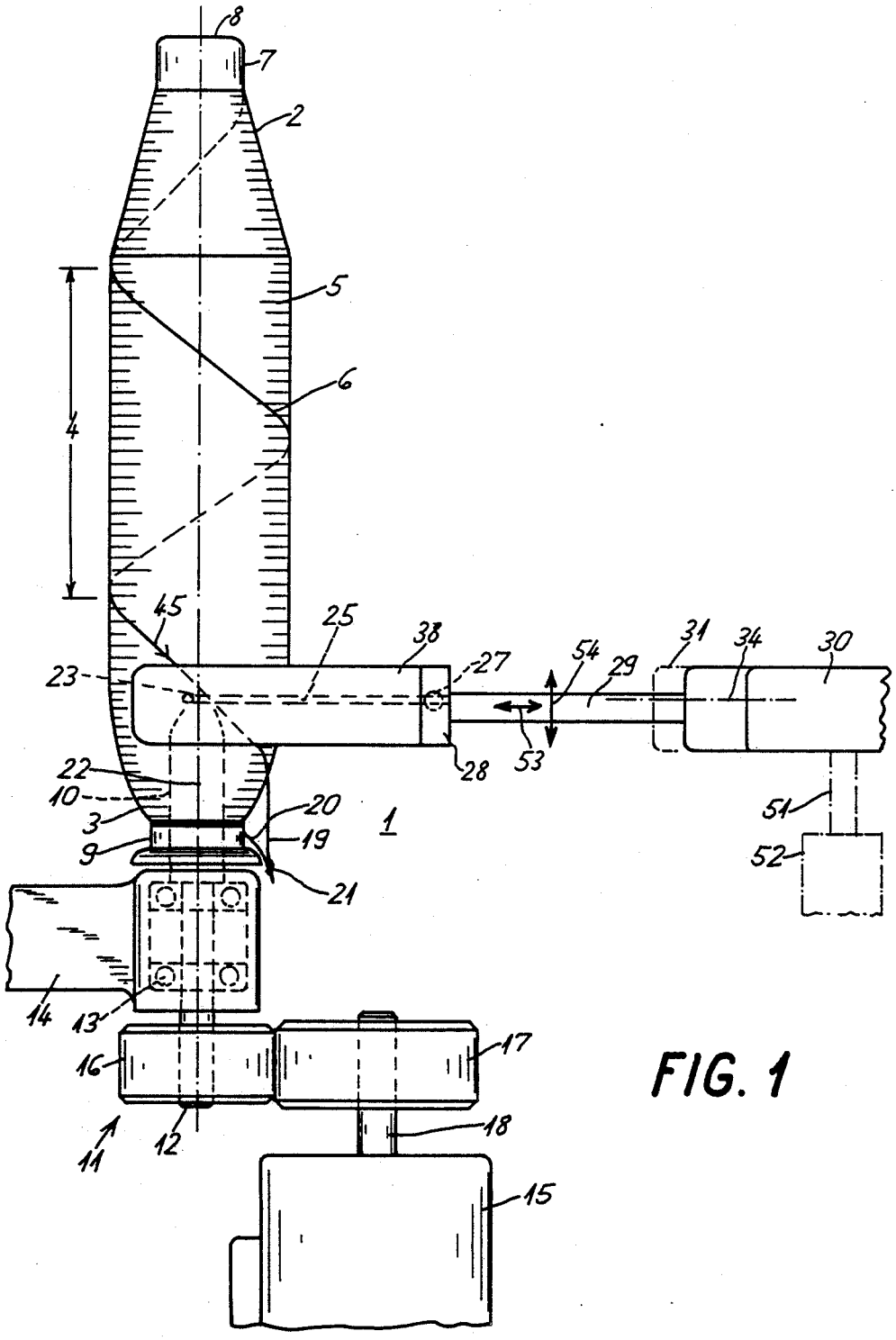
FIG. 1 is a front elevational view of an apparatus for locating and loosening a reserve yarn winding on a textile cop according to a first embodiment of the present invention.
Figure 2:
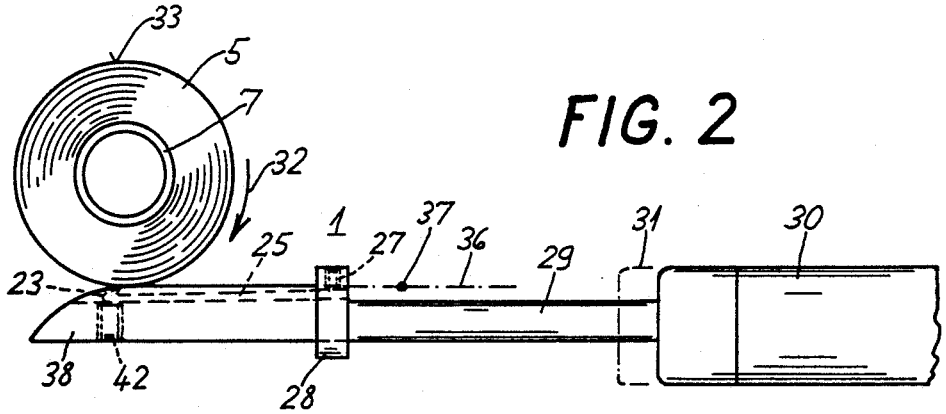
FIG. 2 is a top plan view of the apparatus of FIG. 1.

Referring now to the accompanying drawings and initially to FIGS. 1 and 2, an apparatus according to the preferred embodiment of the present invention for locating and loosening a reserve yarn winding on a textile spinning cop is indicated broadly at 1. A representative cop is indicated at 5 and basically includes a supporting tubular core 7 having a nose portion 8 at its upper end and a foot portion 9 at its lower end with a quantity of a textile yarn wound about the tube 7 terminating in a final reserve winding 6 of the yarn extending with a relatively large rise, indicated at 4, from the cop nose 2 at the upper end of the tube 7 to the cop foot 3 at the lower end of the tube 7. The apparatus 1 includes a cop-rotating arrangement, indicated in its entirety at 11, which has a receiving pin 10 on which the yarn-supporting tube 7 of the co 5 is placed, with the axis of rotation of the pin 10 coaxial with the longitudinal axis 22 of the cop 5. For sake of simplicity, the reserve yarn winding 6 is shown in FIG. 1 as being formed in only approximately two windings about the cop 5, although those persons skilled in the art will recognize and understand that the reserve yarn winding 6 may customarily include up to approximately 10 wraps about the cop 5.

An elongated shaft 12 extends integrally from the receiving pin 10 of the cop-rotating arrangement 11 and is rotatably supported by a bearing 13 affixed to an arm 14 of a frame of the apparatus, not shown in greater detail herein. The machine frame also supports a drive motor 15 having a drive shaft 18 which carries a friction roller 17 positioned in peripheral frictional engagement with a like friction roller 16 carried on the lower end of the shaft 12.

Typically, the cop 5 is a spinning cop wound with a spun yarn such as a cotton yarn produced on a conventional ring spinning machine. Conventionally, the reserve yarn winding on such a cop is formed in an opposite winding direction from the direction in which the main body of the yarn on the cop is wound. Thus, for example, if the main body of yarn on the cop 5 was wound in a clockwise manner at the ring spinning machine, the reserve yarn winding 6 is wound counterclockwise generally in the shape of a screw thread from the cop nose 2 to the cop foot 3. The lower terminal end 19 of the reserve yarn winding 6 is illustrated in FIG. 1 as having become entangled or twisted with the initial leading yarn end 20 originally placed on the tube 7 of the cop 5 at the start of the spinning operation, the entanglement or twisting being designated at 21.

Figure 7:
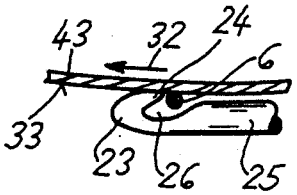
FIG. 7 is a substantially enlarged top plan view of a locating hook according to the present invention.

The apparatus 1 includes a locating implement, preferably a commercially available crochet needle Number 1.25, or a like instrument having an elongated shaft 25 with a hook portion 23 at its outward end terminating in a rearwardly directed rounded tip 24, as best seen on an enlarged scale in FIG. 7. As is customary in crochet needle hooks, an oblique notch 26 is formed in the shaft 25 of the needle adjacent the rearwardly directed tip 24 of the hook portion 23, as shown in FIG. 7.

The longitudinal shaft 25 of the locating implement is fastened to a support member 28 by a clamping screw 27, the support member 28 being mounted to the end of a push rod 29 of a pneumatically-operated control cylinder 30, whereby the support 28 and the locating implement may be advanced and retracted as a unit between an inactive resting position spaced from the cop 5, represented in broken lines in FIG. 1 at 31 for the support member 28 and by the point 37 in FIG. 2 for the hook 23 of the locating implement, and an operative position with the locating implement disposed adjacent the cop 5, as shown in solid lines in FIG. 1. As shown in FIG. 2, the cop rotating arrangement 11 is operative to rotate the cop 5 in a clockwise direction, indicated by the arrow 32. When the locating implement is advanced from its inactive resting position to its operating position, the rearwardly directed tip 24 of the hook portion 23 is thereby placed into contact with the outer peripheral surface 33 of the cop 5 with the tip 24 facing opposite the direction 32 of cop rotation.

Figure 3:
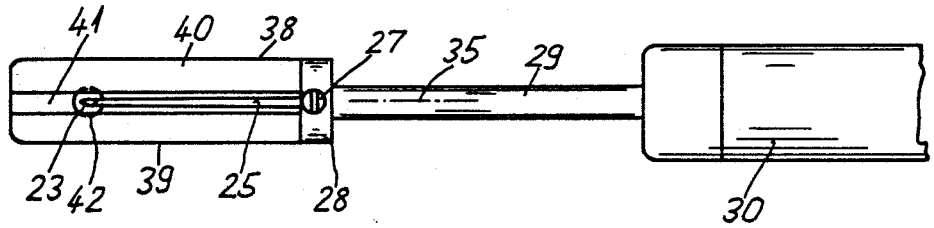
FIG. 3 is a rear elevational view of the locating implement and the associated positioning and withdrawing means of the apparatus of FIGS. 1 and 2.

More specifically, the pneumatic control cylinder 30 is operative to advance and retract the support member 28 and the attached yarn locating implement toward and away from the cop 5 in an essentially linear path of movement, indicated at 35 in FIG. 3, essentially defined at the intersection of a first plane 34 (FIG. 1) oriented substantially perpendicularly to the longitudinal axis 22, i.e. the rotational axis, of the cop 5 and a second plane 36 (FIG. 2) oriented substantially tangentially to the outer peripheral surface 33 of the cop 5 parallel to its axis of rotation and perpendicular to the plane 34.

The time period during which the hook 23 of the locating implement is maintained in peripheral contact with the rotating cop 5 when in the operating position of the locating implement may be selectively determined by the control device 30, which preferably is preset to limit the period of such engagement to a sufficient time for the cop-rotating arrangement 11 to cause the cop 5 to complete between approximately one and two revolutions.

As shown in FIGS. 1–3, a guide member 38 is also attached to support member 28 for guiding the hook 23 of the locating implement when in its operative disposition for locating the reserve yarn winding 6. Thus, the guide member 38 is arranged to move as a unit with the support member 28 and the locating implement. The guide member includes two support surfaces 39, 40, best seen in FIG. 3, extending along opposite sides of the locating implement immediately adjacent its hook portion 23, the support surface 39 being located below the hook 23 and the support surface 40 being located above the hook 23. The support surfaces 39, 40 define a recess 41 in the guide member 38 between the support surfaces 39, 40 within which the shaft 25 and the hook 23 of the locating implement are disposed. As best seen in FIG. 2, the outward end portions of the support surfaces 39, 40 at the free end of the guide member 38 are of a generally arcuate configuration curving rearwardly away from the cop 5.

The support surfaces 39, 40 of the guide member 38 engage the outer periphery 33 of the cop 5 adjacent opposite sides of the hook portion 23 when the support member 28 is advanced into the operative position. In order to achieve a desirable level of contact pressure exerted by the support surfaces 39, 40 against the outer cop periphery 33, an elastic mounting (not shown) of the control cylinder 30 may be provided and, in addition, the push rod 29 of the control cylinder 30 preferably exhibits a degree of elasticity or resiliency. Further, as will be understood, the build-up of yarn windings about the cop 5 is not a particularly rigid structure so that the windings tend to yield in response to contact pressure by the guide member 38 against the cop periphery 33.

An adjustment device, preferably in the form of an adjustment screw 42, is supported by the guide member 38 to extend into its recess 41 for engagement with the shaft 25 of the locating implement for fine adjustment of the disposition of its hook portion 23 relatively toward and away from the outer peripheral surface 33 of the cop 5, as best seen and understood in FIGS. 2 and 3.

The normal contemplated method of operation of the apparatus 1 for locating and loosening the reserve yarn winding 6 from the cop 5 may thus be understood. Initially, the foot 9 of the yarn-supporting tube 7 of the cop 5 is placed on the receiving pin 10 of the cop-rotating arrangement 11, after which the cop-rotating arrangement 11 is placed into operation to rotate the cop 5 in the same direction as the original winding of yarn thereabout during the ring spinning process, i.e., opposite the direction of winding of the reserve yarn winding 6, represented by the arrow 32 in FIG. 2. The control cylinder 30 is then operated to advance the support member 28, the yarn locating implement, and the guide member 38 as a unit into the aforedescribed operative disposition wherein the tip 24 of the hook 23 is engaged in contact with the outer peripheral surface 33 of the cop 5, shown representatively in FIG. 7 on an enlarged scale. In FIG. 7, the outer periphery of the cop is symbolized by the arcuate yarn piece 43 while the reserve yarn winding 6 is representatively shown as extending transversely across the yarn piece 43. Preferably, the control cylinder 30 is operative to perform advancement of the support member 28, the locating implement, and the guide member 38 at a relatively brisk or rapid rate. As the cop 5 rotates, the reserve yarn winding 6 is transported in the direction 32 of cop rotation and is thereby caused to move behind the rearwardly directed tip 24 of the hook 23 and into the recess 26 of the locating implement, as representatively shown in FIG. 7. Such engagement of the reserve yarn winding 6 within the hook 23 normally should occur within the first complete revolution of the cop 5 following engagement of the hook 23 with the outer cop periphery. After completion of the predetermined time of hook engagement with the cop 5 as controlled by the cylinder 30, e.g., one to two revolutions of the cop 5 as aforementioned, the control cylinder 30 operates to withdraw the support member 28, the locating implement and the guide member 38 tangentially away from the cop 5 out of engagement therewith, also preferably in a brisk manner. The reserve yarn winding 6 is carried within the hook 23 of the locating implement as it is thusly withdrawn away from the cop 5 and generally should readily loosen from the entanglement 21 during withdrawal of the hook 23, if the reserve winding 6 has not already by this time been dislodged from the twisting 21, whereby the reserve winding 6 hangs loosely downwardly from the cop nose 2. However, if the entanglement 21 should be rather strong, the reserve yarn winding 6 will ultimately break at an intermediate point along its length and then likewise hang loosely from the cop nose.

Figure 4:
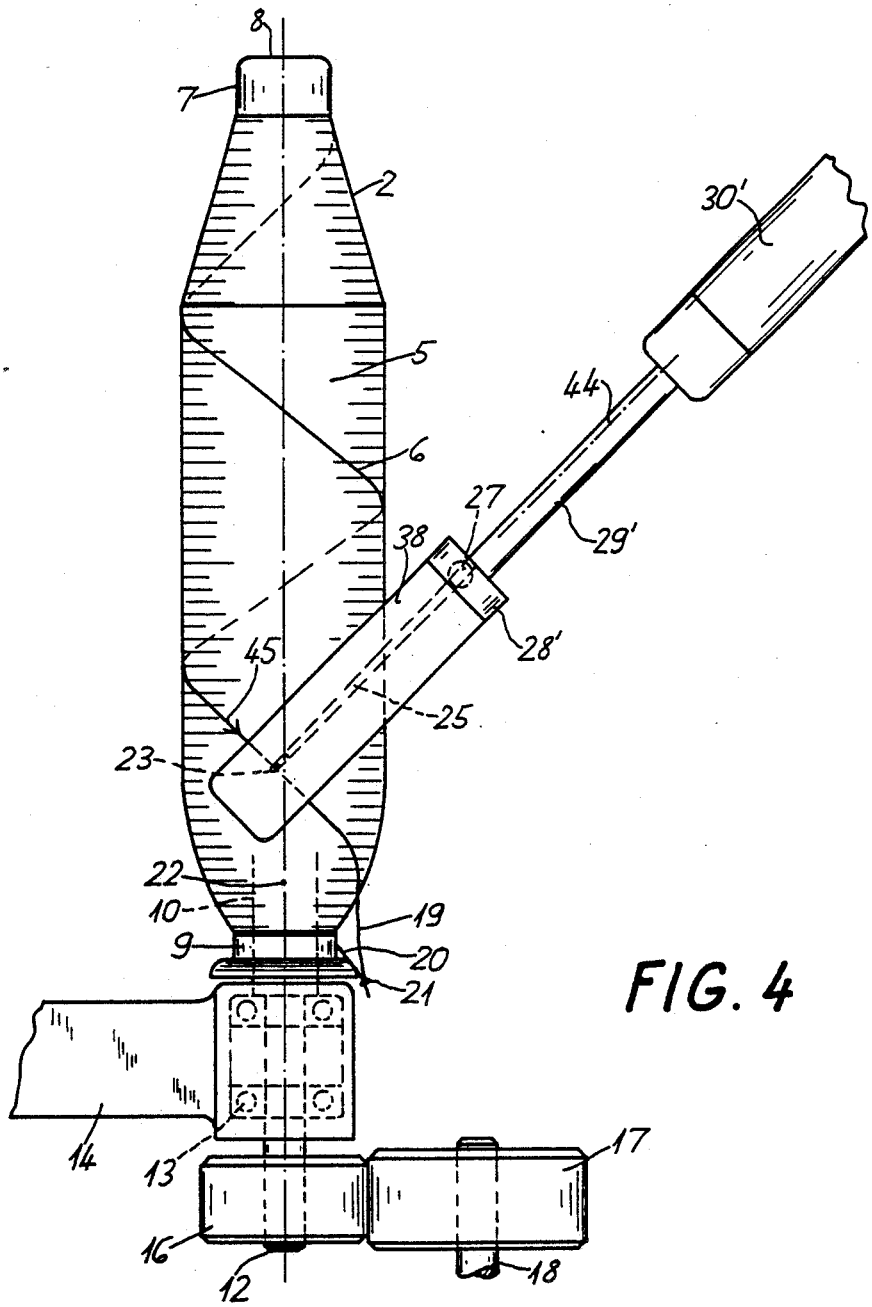
FIG. 4 is a front elevational view, similar to FIG. 1, of an apparatus for locating and loosening a reserve yarn winding on a textile cop according to a second embodiment of the present invention.

An alternate embodiment of the reserve yarn locating and loosening apparatus of the present invention is shown in FIG. 4 and basically differs from that of FIGS. 1–3 in the orientation and operational direction of the locating implement. As shown in FIG. 4, the locating implement is attached to a support 28' mounted to the end of a push rod 29' of a control cylinder 30' for advancement and withdrawal toward and away from the cop 5 along a linear path of movement defined by the intersection of a plane 36 oriented substantially tangentially to the cop periphery and a plane 44 oriented perpendicularly to the tangential plane 36 and obliquely with respect to the longitudinal axis of rotation 22 of the cop 5. This orientation and path of movement of the locating implement assures that the control cylinder 30' advances and withdraws the support member 28, and the locating implement not only with a component of movement tangential to the cop 5 but also with a component of movement substantially more transverse with respect to the direction of lengthwise extent of the reserve yarn winding 6, indicated at 45. Thus, as shown in FIG. 4, the linear path of movement of the support member 28' and the locating implement is essentially perpendicular to the lengthwise directional extent 45 of the reserve yarn winding 6 at the point at which the hook 23 of the locating implement engages the reserve yarn winding 6. Such an arrangement of the control cylinder 30', its push rod 29', the support member 28', the guide device 38' and the yarn locating implement effectively achieves a more reliable engagement and loosening of the reserve yarn winding 6 when the hook 23 of the locating implement is withdrawn.

Figure 5:
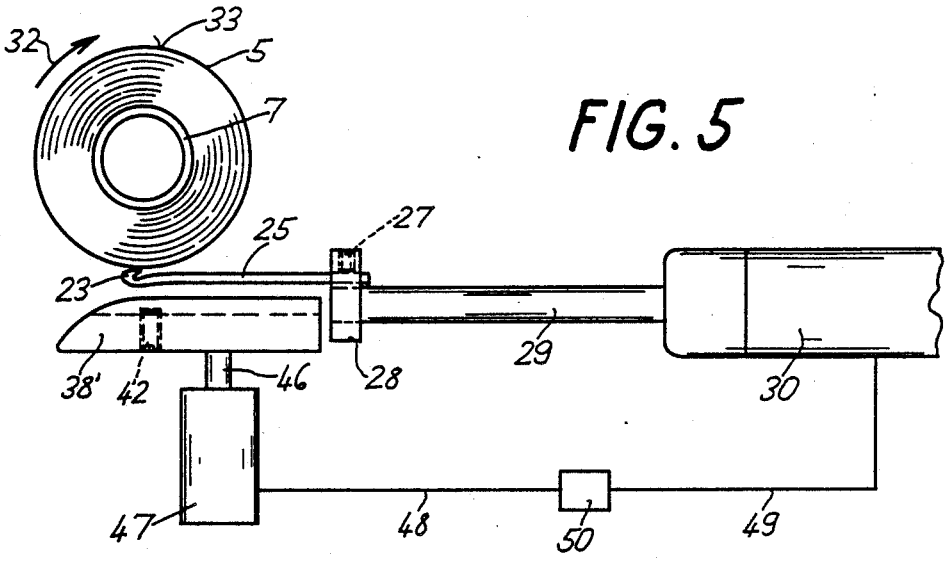
FIG. 5 is a top plan view of another apparatus for locating and loosening a reserve yarn winding on a textile cop according to a third embodiment of the present invention.
Figure 6:
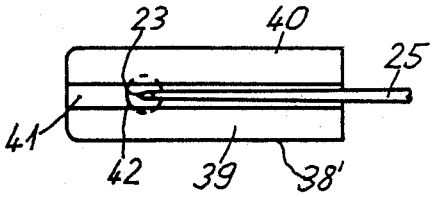
FIG. 6 is a partial rear elevational view of the locating hook and the guide member of the apparatus of FIG. 5.

FIGS. 5 and 6 illustrate a further embodiment of the apparatus of the present invention wherein a guide member 38' for the yarn locating implement is supported independently of the support member 28 for movement into and out of engagement with the outer cop periphery independently of, although in relation to, the advancement and retraction of the yarn locating implement. Specifically, the guide member 38 is mounted to a push rod 46 of a pneumatic control cylinder 47, each of the control cylinders 47, 30 being connected by pneumatic control lines 48, 49 to a central control unit 50 which coordinates the actuating movements of the control cylinders 30, 47. In operation, immediately after the advance of the push rod 29 by the control cylinder 30 to bring the yarn locating implement into its operative disposition in engagement with the cop 5, the control cylinder 47 is actuated to likewise advance its push rod 46 to place the guide member 38' in engagement with the outer cop periphery 33 while at the same time bringing an adjustment screw 42 supported on the guide member 38' into engagement with the yarn locating hook 23. Subsequently, the control cylinder 30 is initially operated to withdraw the push rod 29 and therewith the support member 28 and the yarn locating implement, after which the control cylinder 47 is operated to withdraw the push rod 46 and the guide member 38'.

Importantly, as those persons skilled in the art will readily recognize, the apparatus and method of the present invention is not limited to the exemplary embodiments herein shown and described. For example, it is possible in the embodiment of FIG. 1 to arrange the support member 28 for manipulation in two directions as indicated by the directional arrows 53, 54. Specifically, for example, the control cylinder 30 may itself be positioned on the push rod 51 of another control cylinder 52 operative perpendicularly to the push rod 29 of the control cylinder 30. Thus, the locating hook 23 may be advanced and withdrawn in a direction substantially perpendicularly or otherwise transversely with respect to the lengthwise directional extent 45 of the reserve yarn winding 6 by simultaneous operation of the push rods 29, 51 of the respective control cylinders 30, 52, whereby the support 23 is moved both horizontally in the direction of the arrow 53 and vertically in the direction of the arrow 54. Accordingly, by operating the control cylinder 30 to withdraw its push rod 28 and simultaneously operating the control cylinder 52 to advance its push rod 51, the yarn locating hook 23 may be withdrawn from its operative position essentially perpendicularly with respect to the lengthwise extent of the reserve yarn winding 6. As will be understood, the extent or degree of the operative motion in either or both directions 53, 54 may be freely selected and adjusted in order to adapt the direction of advancement and withdrawal of the yarn locating implement with respect to any particular rise of the reserve yarn winding 6 in a simple manner.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention.

The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

I claim:

1. A method for locating and loosening a reserve yarn winding on a textile spinning cop or a like textile yarn bobbin of the type wherein the reserve yarn winding is wound with a relatively large rise from a nose end of the cop to a foot end of the cop, said method comprising the steps of rotating the cop around its longitudinal axis; providing a locating implement having a hook formed with a reversely directed rounded tip; during the rotation of the cop, positioning the tip of the hook in contact with the outer periphery of the cop and facing oppositely of the direction of cop rotation for catching the reserve yarn winding with the hook; providing a guide member for guiding the hook during said positioning of the hook; positioning said guide member in engagement with the outer periphery of the cop during said positioning of the hook; and thereafter withdrawing the hook generally tangentially from the cop for pulling the reverse yarn winding to loosen it from the cop.

2. A method for locating and loosening a reserve yarn winding from a textile spinning cop or a like textile yarn bobbin according to claim 1 and characterized further in that said rotating the cop is in a direction about its longitudinal axis opposite the winding direction of the reserve yarn winding.

3. A method for locating and loosening a reserve yarn winding from a textile spinning cop or a like textile yarn bobbin according to claim 1 and characterized further in that said locating implement comprises a crochet-type needle.

4. A method for locating and loosening a reserve yarn winding from a textile spinning cop or a like textile yarn bobbin according to claim 1 and characterized further in that said positioning the tip of the hook comprises maintaining the tip of the hook in contact with the outer periphery of the cop for a predetermined time sufficient for the cop to complete between approximately one and two revolutions, and said withdrawing the hook is performed thereafter regardless of whether the hook successfully catches the reserve yarn winding.

5. A method for locating and loosening a reserve yarn winding from a textile spinning cop or a like textile yarn bobbin according to claim 1 and characterized further in that said withdrawing the hook is in a direction substantially transverse with respect to the reserve yarn winding.

6. A method for locating and loosening a reserve yarn winding from a textile spinning cop or a like textile yarn bobbin according to claim 1 and characterized further in that said positioning the tip of the hook in contact with the outer periphery of the cop comprises advancing the hook tangentially with respect to the cop in the same path of movement as said withdrawing of the hook.

7. Apparatus for locating and loosening a reserve yarn winding on a textile spinning cop or a like textile yarn bobbin of the type wherein the reserve yarn winding is wound with a relatively large rise from a nose end of the cop to a foot end of the cop, said apparatus comprising means for supporting and rotating a cop about its longitudinal axis, a locating implement having a hook formed with a reversely directed rounded tip, and means for positioning the tip of the hook in contact with the outer periphery of the cop with the tip facing oppositely of the direction of cop rotation for catching the reserve yarn winding with the hook and for withdrawing the hook generally tangentially from the cop for pulling the reverse yarn winding to loosen it from the cop, said positioning and withdrawing means comprising a guide member for engagement with the outer periphery of the cop during positioning of the hook for guiding the hook during its positioning.

8. Apparatus for locating and loosening a reserve yarn winding on a textile spinning cop or a like textile yarn bobbin according to claim 7 and characterized further in that said locating implement comprises a crochet-type needle.

9. Apparatus for locating and loosening a reserve yarn winding on a textile spinning cop or a like textile yarn bobbin according to claim 7 and characterized further in that said cop supporting and rotating means rotates the cop in a direction about its longitudinal axis opposite the winding direction of the reserve yarn winding.

10. Apparatus for locating and loosening a reserve yarn winding on a textile spinning cop or a like textile yarn bobbin according to claim 8 and characterized further by control means associated with said positioning and withdrawing means for maintaining the tip of the hook in contact with the outer periphery of the cop for a predetermined time sufficient for the cop supporting and rotating means to complete between approximately one and two revolutions of the cop.

11. Apparatus for locating and loosening reserve yarn winding on a textile spinning cop or a like textile yarn bobbin according to claim 8 and characterized further in that said positioning and withdrawing means is arranged for withdrawing the hook in a direction substantially transverse with respect to the reserve yarn winding.

12. Apparatus for locating and loosening a reserve yarn winding on a textile spinning cop or a like textile yarn bobbin according to claim 7 and characterized further in that said positioning and withdrawing means comprises a movable support member for supporting and manipulating said locating implement, said guide member being attached to said support member.

13. Apparatus for locating and loosening a reserve yarn winding on a textile spinning cop or a like textile yarn bobbin according to claim 7 and characterized further in that said positioning and withdrawing means includes means for adjusting the disposition of the hook relative to the outer periphery of the cop.

14. Apparatus for locating and loosening a reserve yarn winding on a textile spinning cop or a like textile yarn bobbin according to claim 7 and characterized further in that said guide member includes cop engagement surfaces at opposite sides of said hook.

* * * * *